US005209861A

United States Patent [19]

Gschwender et al.

[11] Patent Number: 5,209,861

[45] Date of Patent: May 11, 1993

[54] HIGH TEMPERATURE NONFLAMMABLE HYDRAULIC FLUID

[75] Inventors: Lois J. Gschwender, Kettering; Carl E. Snyder, Jr., Trotwood, both of Ohio

[73] Assignee: The United States of America as represented by the Secretary of the Air Force, Washington, D.C.

[21] Appl. No.: 882,399

[22] Filed: May 13, 1992

[51] Int. Cl.[5] ..... C10M 105/50; C10M 135/10

[52] U.S. Cl. ..... 252/33.2; 252/47.5; 252/58; 252/78.1

[58] Field of Search ..... 252/47.5, 58, 33.2; 564/96

[56] References Cited

U.S. PATENT DOCUMENTS

| | | | |
|---|---|---|---|
| 2,915,554 | 12/1959 | Ahlbrecht et al. | 564/96 |
| 3,321,445 | 5/1967 | Lazerte et al. | 564/96 |
| 3,734,962 | 5/1973 | Niederprüm et al. | 564/96 |
| 3,994,815 | 11/1976 | Coleman | 252/52 R |
| 4,101,468 | 7/1978 | Perrey et al. | 564/96 |
| 4,265,831 | 5/1981 | Mitschke et al. | 564/96 |
| 4,468,527 | 8/1984 | Patel | 564/96 |
| 4,528,109 | 7/1985 | Fifolt et al. | 252/58 |
| 4,596,664 | 6/1986 | Fifolt et al. | 252/75 |
| 4,895,674 | 1/1990 | Gallacher et al. | 252/389.52 |
| 4,900,463 | 2/1990 | Thomas et al. | 252/54 |

*Primary Examiner*—Ellen McAvoy

*Attorney, Agent, or Firm*—Charles E. Bricker; Donald J. Singer

[57] ABSTRACT

A high temperature, nonflammable working fluid consisting essentially of about 0.1 to 5.0 w/o of a rust-/corrosion-inhibitor and about 0.01 to 1.0 w/o of a lubricity additive, balance a chlorotrifluoroethylene oligomer base oil, wherein the lubricity additive is a sulfonamide having the formula $C_8F_{17}SO_2N(C_2H_5)CH_2CH_2O(CH_2CH_2O)_nH$, wherein n has a value of 0 to 15, and wherein the rust inhibitor comprises a blend of zinc dinonylnaphthalene sulfonate and a zinc salt of a high molecular weight succinate ester in a weight ratio of about 99:1 to 20:80.

2 Claims, No Drawings

HIGH TEMPERATURE NONFLAMMABLE HYDRAULIC FLUID

RIGHTS OF THE GOVERNMENT

The invention described herein may be manufactured and used by or for the Government of the United States for all governmental purposes without the payment of any royalty.

BACKGROUND OF THE INVENTION

This invention relates to improved hydraulic fluids, particularly to high temperature, nonflammable hydraulic fluids.

Many hydraulic fluids commonly used are mineral, naphthenic, or synthetic oils which have been selected primarily on the basis of hydraulic properties, without regard for nonflammability requirements. These fluids tend to be highly flammable and cannot be rendered nonflammable by the use of additives or special processing.

Among the synthetic oils which have acceptable hydraulic properties and which are also commercially available are the chlorotrifluoroethylene-derived oils (hereinafter referred to as "CTFE" oils). These oils are essentially nonflammable due to their high degree of halogenation and can thus be used in hydraulic applications where the non-reactivity of the fluid is an essential requirement. CTFE oils are saturated, low molecular weight oligomers of chlorotrifluoroethylene, typically having about 2 to 10 repeating units in the oligomer chain. The terminal groups of the oligomer chain are generally derived from the catalyst and/or the solvent used in the oligomerization process. The chemical and thermal stability of such CTFE oils is enhanced by chlorination or fluorination of the terminal groups of the oligomer.

CTFE oils are not generally useful by themselves. They do not provide the degree of rust- and corrosion-inhibition provided by hydrocarbon fluids. The viscosity and pressure-viscosity coefficients of unformulated CTFE, at higher temperatures, are much lower than those for hydrocarbon-based hydraulic fluids. This results in lower elastohydrodynamic (EHD) film thickness at the ball/race contact, thereby creating a mixed lubrication regime instead of the desired full separation. Excessive metal-to-metal contact can result in premature failure of critical pump components such as the rolling bearings and splines.

Accordingly, in order to provide a useful CTFE working fluid, it is desirable to incorporate at least a rust-/corrosion-inhibitor and a lubricity additive into the base fluid. Unfortunately, it has been found that many otherwise effective antirust additives, when formulated with lubricity additives, cause the lubricity additive to become ineffective.

Accordingly, it is an object of this invention to provide a CTFE-based working fluid comprising a rust-/corrosion-inhibitor and a lubricity additive.

Other objects and advantages of the invention will be apparent to those skilled in the art.

SUMMARY OF THE INVENTION

In accordance with the present invention, there is provided a high temperature, nonflammable working fluid consisting essentially of about 0.1 to 5.0 w/o of a rust-/corrosion-inhibitor and about 0.01 to 1.0 w/o of a lubricity additive, balance a saturated chlorotrifluoroethylene oligomer base oil.

The lubricity additive is a sulfonamide having the formula

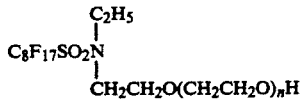

$$C_8F_{17}SO_2N(C_2H_5)CH_2CH_2O(CH_2CH_2O)_nH$$

wherein n has a value of 0 to 15. This sulfonamide is available in experimental quantities from Minnesota Mining and Manufacturing Co., Minneapolis, MN, under the designation L1478.

The rust inhibitor comprises a blend of zinc dinonylnaphthalene sulfonate and a zinc salt of a high molecular weight succinate ester in a weight ratio of about 99:1 to 20:80. The rust inhibitor is available from King Industries, Inc., Norwalk, Conn., under the tradename Nasul ZnHT.

The following example illustrates the invention.

EXAMPLE

A hydraulic fluid was prepared containing 0.5% ZnHT antirust additive and 0.05% of the sulfonamide lubricity additive described previously, balance CTFE.

Various tests were conducted on this fluid as follows: Kinematic viscosities were determined per ASTM D-445. Total acid numbers were determined per ASTM D-664. Four ball wear tests were performed per ASTM D-2266 (1200 rpm, 40 kg load, 1 hour, 75° C., with 52100 steel 1.27 cm diameter balls). Oxidation-corrosion stabilities were determined per ASTM D-4636 (135° C., 168 hours, 5 l/hr air flow in the reflux configuration; metals used were M50 steel, Al, Mg, Cd and Cu).

The antitrust test or Corrosion Rate Evaluation Procedure (CREP) was performed as follows: A 2-liter grease kettle was used with 100 ml deionized water boiling in the bottom, heated on a hot plate. Dry bottled air was introduced into the kettle at a rate of 500 ml/min with the air tube positioned 90 mm from the bottom of the kettle. Cleaned and sanded ANSI 1010 steel panels, 12.7 by 50.8 by 1.6 mm, were dipped into the test fluid, a reference oil (CTFE with no additive) and a second reference oil (CTFE with 0.5% barium dinonylnaphthalene sulfonate (BSN) antirust additive). After hanging in a draft-free enviroment for 15 minutes, the panels were suspended from nichrome wire in the temperature-equilibrated vapor phase of the grease kettle. The kettle was covered. After one hour, the panels were removed from the kettle and the test fluid panel was visually rated in comparison to the two reference panels, with the CTFE panel having a rating of 0 and the CTFE/BSN panel having a rating of 10.

Thermal stability screening was conducted in an apparatus consisting of a 230 mm long by 19 mm O.D., type 304 stainless steel tube sealed with type 316 stainless steel swaged fittings. Three 12.7 mm diameter metal balls, one each of M50 tool steel, 52100 steel and naval bronze, were placed in the apparatus, together with 20 ml of the test fluid. The tube was flushed with $N_2$ for 5 minutes, sealed and then placed in an oven at 175° C. After 72 hours, the tube was removed from the oven, cooled and disassembled. The total acid number and kinematic viscosity were determined on the stressed fluid. Metal weight changes were determined on the test balls.

The rocking bomb test was conducted using 100 ml of fluid, for 72 hours, in air, at 175° C.

The results of these tests are shown in the following Table.

TABLE

| Property | Target Value | Formulation |
|---|---|---|
| Viscosities (cSt) | | |
| −54° C. | 1200 max | 766 |
| −40 | | 150 |
| 38 | 3.0 min | 3.03 |
| 99 | | 1.01 |
| 135 | 0.60 min | 0.67 |
| Total Acid Number (mg KOH/gm) | 0.6 max | 0.39 |
| CREP | 10 min | 10 |
| Four Ball Wear Scar | 1.0 max | 0.56 |
| Oxidation-Corrosion | | |
| % Visc change at 38° C. | 5.0 max | −1.3 |
| Acid Nr Change (mg KOH/gm) | 0.4 max | 0.11 |
| % Fluid weight loss | 8.0 max | 1.5 |
| Metal Weight Change ($mg/cm^2$) | | |
| Cd | 0.2 max | 0.19 |
| Mg | 0.2 max | 0.00 |
| M50 steel | 0.2 max | 0.00 |
| Al | 0.2 max | 0.00 |
| Cu | 0.6 max | 0.21 |
| Fluid Appearance | Report | Brown, clear |
| Thermal Stability | | |
| % Visc change at 38° C. | 5.0 max | 1.0 |
| Acid Nr Change (mg KOH/gm) | 0.4 max | 0.03 |
| Bomb wt loss (gm) | 0.2 max | 0.1 |
| Metal Weight Change ($mg/cm^2$) | | |
| 51-100 Steel ball | 0.2 max | +0.01 |
| Naval Bronze | 0.8 max | −0.28 |
| M10 | 0.2 max | +0.01 |
| Fluid Appearance | No black ppt. | Light brown, hazy |
| Rocking Bomb | | |
| % Visc change at 38° C. | 5.0 max | 0.0 |
| Acid Nr Change (mg KOH/gm) | 0.4 max | 0.5 |
| Metal Weight Change ($mg/cm^2$) | | |
| 52-100 Steel ball | 0.2 max | 0.22 |
| 4640 bronze disc | 0.2 max | 0.34 |
| Ti—3Al-2.5V tube | 0.2 max | 0.22 |
| 4340 M steel disc | 0.2 max | 0.20 |
| M50 steel ball | 0.2 max | 0.29 |
| 21-6-9 steel tube | 0.2 max | 0.25 |
| 440C steel ball | 0.2 max | 0.29 |
| 6061-T6 Al wafer | 0.2 max | 0.20 |
| 15-5PH steel disc | 0.2 max | 0.17 |
| K6E cast iron ring | 0.2 max | 0.24 |
| Nitralloy steel disc | 0.2 max | 0.25 |
| Fluid Appearance | No black ppt. | Brown, slight cloud |

Various modifications may be made to the invention as described without departing from the spirit of the invention or the scope of the appended claims.

We claim:

1. A high temperature, nonflammable working fluid consisting essentially of about 0.1 to 5.0 w/o of a zinc-based rust inhibitor and about 0.01 to 1.0 w/o of a sulfonamide, balance a chlorotrifluoroethylene oligomer base oil; wherein said sulfonamide has the formula $C_8F_{17}SO_2N(C_2H_5)CH_2CH_2O(CH_2CH_2O)_nH$, wherein n has a value of 0 to 15; and wherein said rust inhibitor comprises a blend of zinc dinonylnaphthalene sulfonate and a zinc salt of a high molecular weight succinate ester in a weight ratio of about 99:1 to 20:80.

2. The fluid of claim 1 containing 0.5% of said rust inhibitor and 0.05% of said sulfonamide.

* * * * *